US012440045B2

(12) United States Patent
Schoon

(10) Patent No.: US 12,440,045 B2
(45) Date of Patent: Oct. 14, 2025

(54) DISPOSABLE LID DISPENSER ASSEMBLY

(71) Applicant: CFS Brands, LLC, Oklahoma City, OK (US)

(72) Inventor: Jodie Schoon, East Troy, WI (US)

(73) Assignee: CFS Brands, LLC, Oklahoma City, OK (US)

( * ) Notice: Subject to any disclaimer, the term of this patent is extended or adjusted under 35 U.S.C. 154(b) by 433 days.

(21) Appl. No.: 17/942,878

(22) Filed: Sep. 12, 2022

(65) Prior Publication Data

US 2023/0084043 A1 Mar. 16, 2023

Related U.S. Application Data

(60) Provisional application No. 63/261,169, filed on Sep. 14, 2021.

(51) Int. Cl.
*A47F 1/10* (2006.01)

(52) U.S. Cl.
CPC ..... *A47F 1/106* (2013.01)

(58) Field of Classification Search
CPC ..... A47F 1/106; A47F 1/10; B65G 59/063; B65G 220/0258; B65G 59/108
USPC ..... 221/155
See application file for complete search history.

(56) References Cited

U.S. PATENT DOCUMENTS 1,657,850 A * 1/1928 Barbieri ..... A47F 1/106 221/45
5,038,969 A * 8/1991 Berger ..... G07F 13/10 221/270
5,152,590 A * 10/1992 Dukes ..... A47G 19/32 312/61
5,176,494 A * 1/1993 Nigrelli ..... B65G 59/066 414/797.6
5,358,140 A * 10/1994 Pellegrino ..... A61F 15/001 206/440
6,786,359 B1 * 9/2004 Schroeder ..... G07F 13/10 221/277
7,422,127 B2 9/2008 Christoffersen et al.
7,673,773 B1 * 3/2010 Walsh ..... A47F 1/123 221/221
8,016,158 B2 9/2011 Walsh et al.
9,049,949 B1 * 6/2015 Taylor ..... A47F 1/085
9,271,582 B1 * 3/2016 Pando ..... A47F 1/106
9,609,959 B1 * 4/2017 Taylor ..... A47F 1/106
10,366,560 B2 * 7/2019 Weber ..... G07F 9/026
(Continued)

FOREIGN PATENT DOCUMENTS

CN 214803988 U * 11/2021 ..... B65D 83/0876
GB 2089773 A * 6/1982 ..... A47F 1/106

*Primary Examiner* — Rakesh Kumar
(74) *Attorney, Agent, or Firm* — Boyle Fredrickson, S.C.; Kirk L. Deheck; Adam L. Brookman

(57) ABSTRACT

An assembly and method of forming a dispenser assembly that is constructed to sequentially dispense respective container lids from a stack of container lids housed in the dispenser assembly. The dispenser assembly includes a housing that is generally defined by a base, a cover, a top, and a lid. A guide tube depends from the top and generally overlies a trap door that is operationally connected to an actuator assembly and a drive assembly. A separator assembly is connected to the drive assembly and operative to effectuate separation of discrete lids from an end of the stack of lids during operation of the trap door during each dispense event.

14 Claims, 11 Drawing Sheets

(56) References Cited

U.S. PATENT DOCUMENTS

| | | | | |
|---|---|---|---|---|
| 10,370,174 | B1 * | 8/2019 | McIntosh | G07F 11/16 |
| 2018/0229949 | A1 * | 8/2018 | Fickler | A47F 1/106 |
| 2023/0084043 | A1 * | 3/2023 | Schoon | A47F 1/106<br>221/155 |

* cited by examiner

DISPOSABLE LID DISPENSER ASSEMBLY

CROSS REFERENCE TO RELATED PATENTS

This application claims priority to U.S. Provisional Patent Application Ser. No. 63/261,169 filed on Sep. 14, 2021 titled "Disposeable Lid Dispenser Assembly" and the disclosure of which is expressly incorporated herein.

FIELD OF THE INVENTION

The present invention relates generally to dispensers for convenience stores, food service activities, and fast-food operations and, more particularly, to a dispenser assembly that is constructed to dispense, in a sequential mariner, lids that are constructed to engage disposable containers such as coffee, other beverage cups, soup containers, or the like.

BACKGROUND OF THE INVENTION

Organizers for beverage and other disposable or single use container lids have been employed for many years. Such organizers are widely used in various environments including food service, convenience store, and fast food operations to name a few. In rudimentary forms, a stack of lids is typically supported in a chute, trough, or a shaped holder. This basic concept has taken many forms. In most, lids are substantially exposed to the environment in either a vertical, partially vertical, or substantially horizontal arrangement. Such configurations commonly include vertically oriented partitioned boxes having open or see-through channels or fronts into which one or more stacks of lids are placed. When more than one stack is supported, whether for dispensing similarly sized or different sized lids, each stack can be partitioned off from other stacks such that a plurality of stacks is displayed in side-by-side relation. In this configuration there is normally a wide slot that runs along the longitudinal axis of each stack to permit a user's fingers to access the stack of lids with the intended objective of grasping or removing a desired number of lids either from an open top or an enlarged mouth near the top or bottom of the dispenser to permit the grasped lid/lids to be withdrawn or removed from the dispenser. In other embodiments of this configuration, there are merely bars or corner pieces that restrict or restrain the stack of lids from tipping over, but otherwise such approaches provide negligible protection of the discrete lids or remaining stack of lids from the use environment and/or inadvertent contact by users with more lids than are desired.

Another common approach to dispensing container lids is an arrangement of one or more vertically oriented tubes each having a wide elongated opening running along the longitudinal axis of a stack of lids positioned in the tube. These tubes are most often formed from thin pieces of metal such as aluminum or stainless steel, but can also be formed from a wire mesh material. In such configurations, the elongated slot is generally quite wide such that a lid can be pulled straight out of the tube with some slight flexure or such that a lid can be rotated slightly and removed therefrom. Tube configurations of this type often have platforms at various heights along the inside of the vertical length of the tube so that multiple sizes and/or types of lids can be dispensed from a single tube.

Lids are also sometimes organized horizontally or at an acute presentation angle such as about 30 degrees to about 45 degrees, or the like. In such cases the lids usually rest in a trough with access to the front or back of the respective stack of lids. Often there is an access opening for the lids that is substantially as wide as the lids' diameter, but is restricted by two or more tabs. In such cases a user simply grasps the exposed lid and pulls it. The lid then flexes to allow the lid to be pulled out past the restriction imposed by the tabs and thereby is also manually removed from the lid dispenser.

Most of the above-described lid dispensing solutions fail to protect the lids from contamination and/or from being inadvertently knocked over. Recently, in order to provide more sanitary conditions and to improve the dispensing of lids, others have developed lid dispensers that seek to address these issues. One such lid dispenser assembly is disclosed in U.S. Pat. No. 5,960,989. This dispenser houses the lids completely in sealed tubes with discrete dispensing "units" disposed at a respective end thereof. The dispensing unit comprises a hinged receiver that engages the bottommost lid in a lid stack and then presents that single lid to the user when the hinged receiver is rotated away from the tube mouth. "Bottommost", as used herein, is not intended to be limiting in terms of orientation. Rather, it is merely intended to identify the first (or last) lid in a respective stack of lids. Operation and user interaction with the dispenser assembly is not particularly intuitive and thereby renders the dispenser assembly susceptible to vandalism and/or damage due to the imposition of excessive forces during user interaction therewith.

Further, operation of the dispenser assembly associated with the '989 patent includes various moving parts that are intended to "grasp" an exterior facing contour of a discrete lid being dispensed so as to effectuate the desired removal of the currently dispensing lid from the remainder of the stack of lids contained in the dispenser. Slight deviations relative to the configuration of the stack of lids or a presentation face associated therewith can result in fouling or jamming of the dispense operations, inadvertent concurrent extraction of multiple lids, and/or forceful removal of the lids from the dispenser assembly in a manner can damage the dispensed lid or the perimeter thereof, or one or more of the adjacent lids associated with the stack, and thereby rendering the dispensed lid, or damages adjacent lids, unsuitable for sealing cooperation with an underlying cup or container.

Another lid dispenser assembly is disclosed in U.S. Patent Application Publication No. 2005/0247724. This dispenser assembly includes a fully enclosed tube having a spring-biased pusher platform that biases the lids contained in the tube toward a dispense slot associated with a mouth of the tube and a partial cover assembly that is affixed to the tube. A hinge clip is attached to a trim ring such that the cover can be rotated to a position that does not obstruct or overlie the cavity of the tube such that a sleeve of lids can be fed into the tube. During extraction, discrete lids are grasped at the front edge of a bottommost lid and placing a thumb or a finger on the lid accessible through the notch allows the user to force the bottommost lid through the lid slot.

While this lid dispenser provides certain advantages over other prior art lid dispensers, it also suffers from several drawbacks. The partial cover assembly is cumbersome and expensive to manufacture. Additionally, one or more tools are commonly required to replace the lid or hinge during loading operations. Further, the size of the opening defined by the partial cover assembly is relatively large such that the dispensers will not always reliably function to properly to dispense lids in a "one at a time" manner and in a manner that facilitates the desired separation between adjacent lids of the stack of lids so as to limit user interaction, and thereby a sanitary condition, of adjacent lids. Further still, each extraction event relies on at least partial deformation of a respective bottom most lid during separation of the bottom-most lid from the remainder of the stack of lids. Deformation of the lid during an extraction event presents the potential for splitting or otherwise damaging the discrete extracted lids and/or the adjacent lids thereby rendering the dispensed lid and potentially adjacent lids incapable of sealing operation with a cup or other container. Such instances, if unnoticed, leave the user susceptible to unexpected or unanticipated separation of the lid from an underlying container, inadvertent leakage or spillage of the contents thereof, or if noticed, undesired waste of such inadvertently damaged lids.

Accordingly, there is a need for a lid dispenser assembly that maintains a sanitary condition or isolates a supply of lids from access by the user until dispensed, facilitates separation between discrete adjacent lids, facilitates the separation in a manner that does not damage a lid being dispensed or remaining lids associated with the stack or lids contained therein, is convenient to load and deploy, and whose operation and service interaction is intuitive to both users and service personnel, respectively.

SUMMARY OF THE INVENTION

The present invention provides numerous advantages over the prior art. The present invention permits the storage and sequential dispensing of individual lids such that the lids are substantially shielded from the environment and users of the dispenser assembly until a discrete dispense event. This results in a marked improvement in the preservation of the overall sanitary condition of lids associated with the dispenser assembly. The present invention also incorporates a unique dispensing assembly that permits more effective and repeatable separation of discrete lids from a bulk stack of lids and more repeatable dispense events when lids are available and in a manner that mitigates inadvertent damage to lids being dispensed and those lids that remain associated with the dispenser assembly for subsequent dispensing. The present invention can be accomplished with inexpensive materials so as to be cost effective in price to the marketplace and provides a disposable lid dispenser assembly that is intuitive to operate and deploy for both users as well as service personnel associated with maintaining a desired operating condition of the lid dispenser assembly.

One aspect of the present invention discloses an assembly and method of forming a dispenser assembly that is constructed to sequentially dispense respective container lids from a stack of container lids housed in the dispenser assembly. The dispenser assembly includes a housing that is generally defined by a base, a cover, a top, and a lid. A guide tube depends from the top generally under the lid and overlies a trap door that is operationally connected to an actuator assembly and a drive assembly. A separator assembly is connected to the drive assembly and operative to effectuate separation of discrete lids from an end of the stack of lids associated with the dispenser assembly during operation of the trap door during each dispense event. Accordingly, the dispenser assembly is constructed to maintain a sanitary condition of each lid until the respective lid is dispensed from the assembly and is operable to dispense the lids individually in a manner that separates the lids from the stack of available lids without damaging or exposing adjacent lids to users or the environment.

Another aspect of the present invention that is useable or combinable with one or more of the features, aspects, or objects above discloses a disposable lid dispenser assembly having a base, a top that is connected to the base, and a lid that is pivotably connected to the top. A guide tube depends downwardly from the top and is generally vertically aligned with the lid and defines a column associated with receiving a stack of available lids. A trap door is disposed beneath the guide tube and pivotable relative to the base. A separator assembly is connected to the base and disposed proximate the trap door. The separator assembly includes a respective first lift arm and a respective second lift arm that are each rotational relative to the trap door and movable between a first position wherein the first lift arm and the second lift arm are disposed outside a vertical footprint defined by the column associated with the stack of available lids associated with the guide tube and a second position wherein a portion of the first lift arm and the second lift are rotated into the footprint of the lid stack column and vertically translated relative to the trap door. Motion of the lift arms and trap door effectuate a desired separation and dispensing of a bottom most lid from a stack of similarly sized and frequently at least partially nested disposable lids contained in the dispenser assembly in a sequential manner and a manner that protects a sanitary condition of any lids that have yet to be dispensed.

A further aspect of the invention that includes or is combinable with one or more of the features, aspects, and objects above discloses a lid dispenser assembly having a housing that is defined by a base, a cover panel, a top panel, and a lid that is pivotably connected to the top panel. A guide tube that is shaped to receive a stack of disposable lids is supported by the top panel and extends away from the top panel toward the base. A floor panel is movably connected to the base and disposed proximate a lower end of the guide tube. The dispenser assembly includes a separator assembly that is movable concurrently with the floor panel and operable to interact with a stack of lids disposed in the guide tube to effectuate a physical separation between discrete lids of the stack of lids. The separator assembly includes a first separator finger and a second separator finger that are disposed on generally opposite lateral sides of the guide tube. The first separator finger and the second separator finger are movable in opposite rotational directions, relative to one another, and a common axial direction, relative to the guide tube, to selectively interact with the stack of disposable lids contained in the guide tube during movement of the floor panel such that the dispenser assembly is configured to dispense disposable container lids in a sequential and repeatable manner when the dispenser assembly is employed.

A further aspect of the present invention that is useable or combinable with one or more of the features, aspects, and objects above discloses a method of forming a disposable container lid assembly. The method includes providing a housing that is generally defined by a base, a cover panel, and a top panel. A guide tube is provided and shaped to receive a stack of disposable container lids. The guide tube is constructed to cooperate with the top panel such that the guide tube extends from the top panel toward the base. A trap door is provided and is constructed to pivotably cooperate with the base. A separator assembly is provided that includes a first separator and a second separator that are disposed on generally opposite lateral sides of the guide tube and supported by the base. A drive arrangement is connectable between the trap door and a separator assembly and operable to cause rotation and axial translation of each of the first separator and the second separator relative to the guide tube concurrently during movement of the trap door relative to the base such that the dispenser assembly sequentially dispenses and separates discrete lids from the stack of the available lids. The dispenser assembly is constructed such that operation thereof and the availability of lids to be dispensed therefrom can be readily determined by both service personnel as well as users of the dispenser assembly.

These and other aspects, objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications. Other features, objects, aspects, and advantages of the invention are made apparent from the following description taken together with the drawings. It is further appreciated that the various features, aspects, objects, and advantages disclosed above are not mutually exclusive to the specific summarized aspects of the invention but that the various discrete features, aspects, objects, and advantages are usable and/or combinable with one another.

DESCRIPTION OF THE DRAWINGS

The drawings illustrate the best mode presently contemplated of carrying out the invention.

In the drawings.

Figure 1:
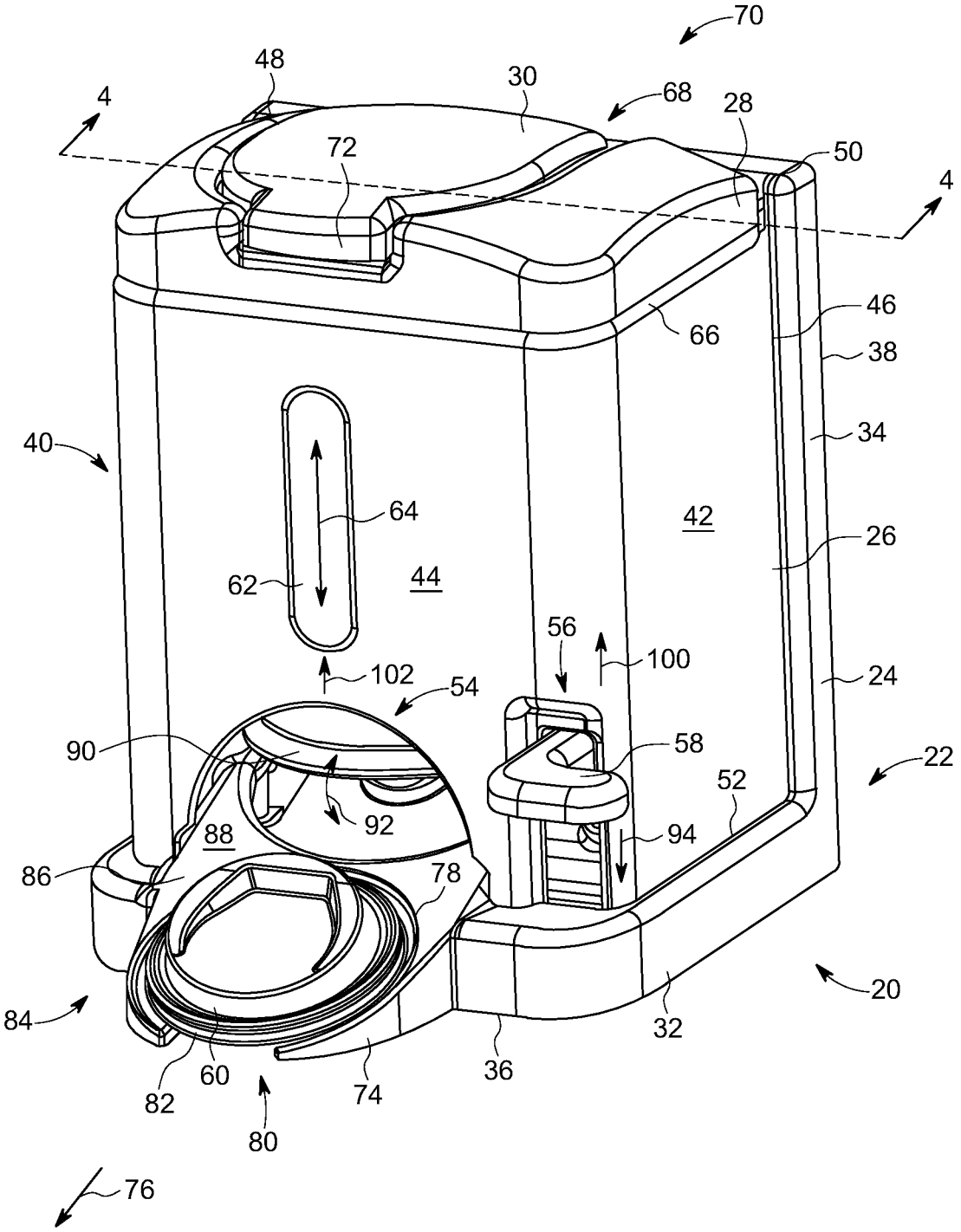
FIG. 1 is a top front right perspective view of a lid dispenser assembly according to the present invention and having an exemplary disposable lid disposed at a retrieval location defined thereby.

Various aspects of the invention are described in detail with reference to the drawings, wherein like reference numerals, including the reference numeral designations, represent like parts and assemblies throughout the several views. Reference to one embodiment does not limit the scope of the claims attached hereto. Additionally, any examples set forth in this specification are not intended to be limiting and merely set forth some of the many possible embodiments for the appended detailed description and claims.

DETAILED DESCRIPTION OF THE PREFERRED EMBODIMENT

The present invention discloses an apparatus, assembly, method for providing, and method for dispensing disposable container lids in a sanitary manner and manner in which a single lid is dispensed with each actuation of a drive arrangement of the dispenser assembly. Referring to FIG. 1, a container lid dispenser assembly or dispenser assembly 20 according to the present invention includes a housing or housing assembly 22 having a body or base 24, a cover panel or cover 26, a top panel or top 28, and a lid 30. Base 24 includes a bottom portion 32 and a back portion 34 that generally, respectively, define a bottom 36 and a rear wall 38 of housing assembly 22. Cover 26 has a generally U-shaped cross-sectional profile defined by a pair of opposing side walls 40, 42 and a front wall 44 disposed therebetween. A rearward directed edge 46 of respective side walls 40, 42 of cover 26 are constructed to cooperate with a respective channel 48, 50 defined by a forward facing portion of rear or back portion 34 of base 24 and a portion of a bottom edge 52 of cover 26 is constructed to engage bottom portion 32 of base 24.

Front wall 44 of cover 26 defines a dispense opening 54 that is generally centrally disposed proximate a lower end thereof. A handle opening 56 is formed through cover 26 and is laterally offset toward a respective side of dispense opening 54. As disclosed further below, when provided in a manually operative construction, a handle 58 extends through handle opening 56 defined by cover 26 and is operable to effectuate operation of a drive arrangement associated with providing sequential dispensing of respective container lids 60 from the confines of housing assembly 22. As disclosed further below, although dispenser assembly 20 is constructed to be manually operable to effectuate the discrete dispense events, as indicated by handle 58, it is appreciated that dispenser assembly 20 could be constructed to be touch-lessly operable to effectuate the discrete dispense events via the inclusion of a proximity sensor or the like and a power consuming drive element, such as a motor, actuator, or the like, and connected the advancement mechanism to effectuate the dispense event. Whether provided in a manual or touch-less operating modality, dispenser assembly 20 preferably includes an inspection window or lens 62 that is supported by cover 26 and extends in a longitudinal direction, indicated by arrow 64, relative to a portion of the height of dispenser assembly 20. Lens 62 is preferably translucent or transparent and allows visual inspection of a quantity of disposable lids 60 contained within housing assembly 22. Lens 62 allows service personnel and users to visually inspect the discrete status of respective dispenser assemblies 20, even from locations remote therefrom, to ascertain the necessity of reloading of the same and/or the availability of lids contained therein, without necessitating physical interaction with the discrete dispenser assemblies 20.

Top 28 of housing assembly 22 is constructed to cooperate with an upwardly directed edge 66 of cover 26 and removably cooperate with housing assembly 22. An opening 68 is defined by cover 26 and shaped to cooperate with movable lid 30 associated with the upwardly directed end 70 of housing assembly 22. As disclosed further below, user interaction with lid 30 facilitates convenient reloading of dispenser assembly 20 when necessary. That is, service personnel can reload dispenser assembly 20 via interaction with lid 30 rather than via removal of top 28 from housing assembly 22. Lid 30 preferably includes a handle portion 72 associated with providing the selectively openable and closable orientation of lid 30 relative to top 28 of housing assembly 22.

Figure 2:
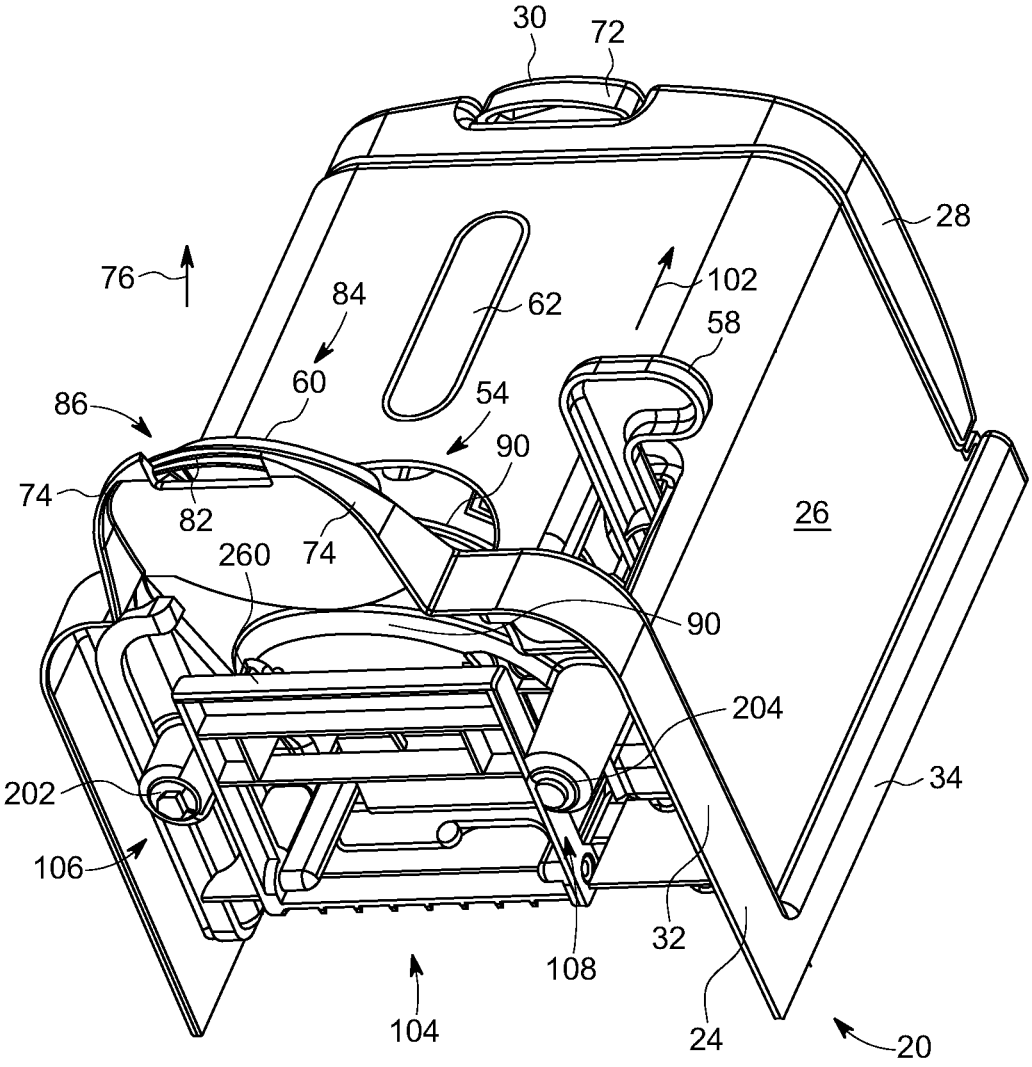
FIG. 2 is bottom front right perspective view of the lid dispenser assembly shown in FIG. 1.
Figure 3:
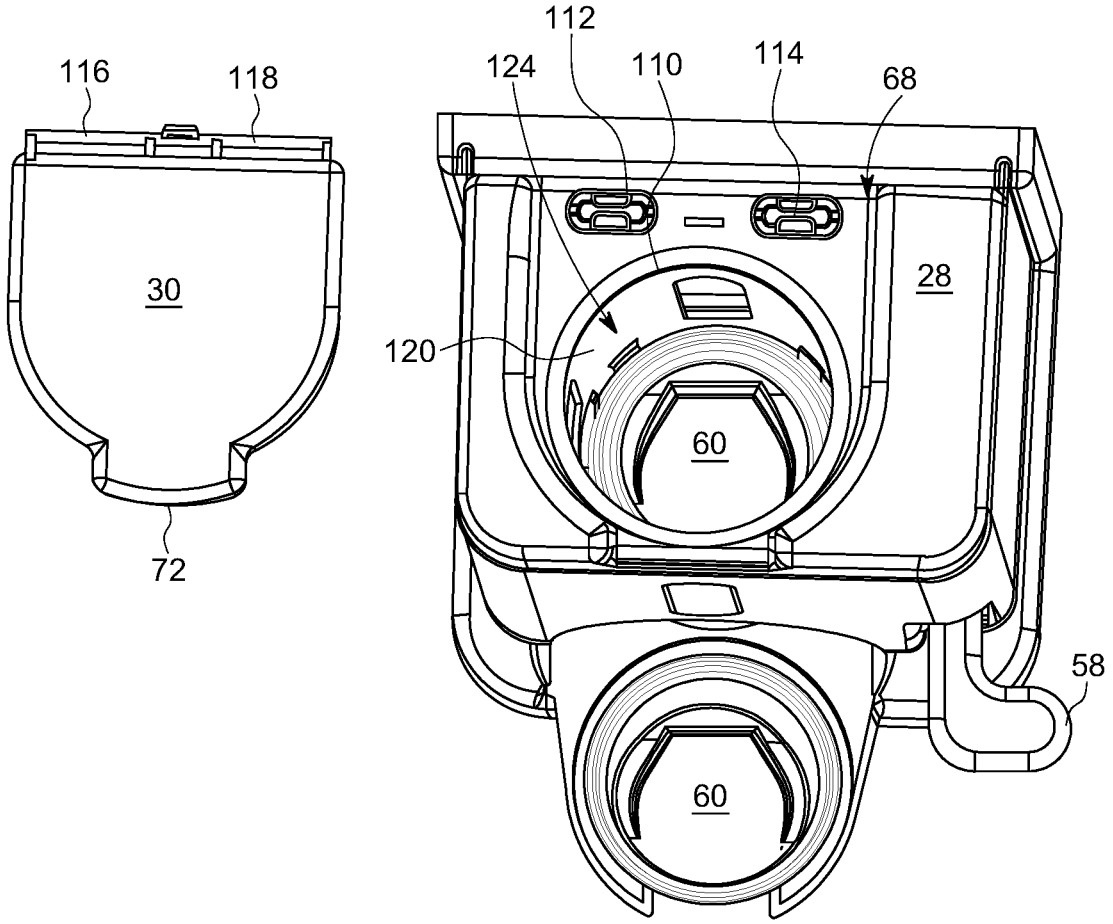
FIG. 3 is a top front perspective view of the lid dispenser assembly shown in FIG. 1 with a lid of the assembly exploded therefrom.

Referring to FIGS. 1 and 2, bottom portion 32 of base 24 includes a projection portion 74 that extends in a forward direction, indicated by arrow 76, relative to cover 26 and proximate dispense opening 54 defined thereby. Projection portion 74 includes an upwardly directed recess 78 associated with a lid retrieval area 84 and that is constructed to slidably receive a respective disposable container lid or simply lid 60 during each dispense event and to be subsequently removed therefrom by the user or consumer. As shown in FIG. 2, a cut out 80 is formed in a forward facing portion of projection portion 74 of base 24. Cut out 80 is shaped to allow the user to grasp a radial edge 82 of a respective container lid 60 deposited in retrieval area 84 associated with the upwardly directed surface of projection portion 74 of base 24.

An upwardly directed surface 86 of projection portion 74 of base 24 that generally surrounds recess 78 in a direction toward dispense opening 54 generally defines a ramp section 88 that is constructed to facilitate the slidable association of discrete lids 60 in direction 76 during each dispense activity. Recess 78 associated with retrieval area 84 captures discrete lids 60 during the discrete dispense events and in a manner wherein lids 60 remained supported by base 24. Recess 78 is constructed to receive the respective lids 60 in a manner that gravitationally secures the respective lids 60 relative to base 24 without allowing the perimeter edge 82 of discrete lids 60 to contact an underlying support surface such as a countertop or the like thereby ensuring the sanitary condition of each dispensed lid.

Still referring to FIGS. 1 and 2, dispenser assembly 20 includes a drop plate or trap door 90 that is visible within the housing assembly 22 through dispense opening 54 formed through cover 26 but is non-physically accessible therethrough. As disclosed further below with respect to FIGS. 6-9, trap door 90 is pivotable or capable of being rotated, as indicated by arrows 92, relative to base 24 in response to operation of handle 58 during each dispense event. During each dispense event, user interaction with handle 58 in a generally downward direction, as indicated by arrow 94, relative to housing assembly 22 effectuates downward rotational translation of trap door 90 such that trap door 90 can attain an orientation wherein an upwardly directed surface of trap door 90 is generally aligned with or slightly below ramp section 88 defined by base 24 (see also FIG. 5B). During a dispense event, the generally aligned orientation of trap door 90 with ramp section 88 provides slidable dispensing of a discrete lid 60 until the respective lid 60 gravitationally drops within recess 78 defined by projection portion 74 of base 24. As disclosed further below, one or more biasing devices such as springs or the like are disposed within dispenser assembly 20 and associated with the dispenser drive assembly and effectuate the return of handle 58 and trap door 90 in respective upward rotational directions, indicated by arrows 100, 102, to return the drive assembly of dispenser assembly 20 to a "ready to dispense" orientation (FIG. 5A) assuming additional container lids are contained thereby.

Referring to FIG. 2, dispenser assembly 20 includes a drive assembly 104 that is operatively disposed between handle 58, trap door 90, and respective separation or separator assemblies 106, 108 to effectuate the desired separation of discrete lids from a stack of available lids and sequential dispensing of a single lid 60 with each actuation of the dispense drive assembly 104 associated with user operation of handle 58. As disclosed further below with respect to FIGS. 8-10, respective separator assemblies 106, 108 are operable to selectively interact with a stack of container lids 60 disposed within dispenser assembly 20 so as to effectuate the sequential separation of the bottom-most lid 60 from the stack of available lids 60 during each sequential dispense event.

Referring to FIGS. 3-5B, top 28 of housing assembly 22 generally includes an opening 110 that, when configured for dispensing operations rather than reloading operations, is disposed beneath lid 30. One or more bosses 112, 114 are defined by top 28 and disposed proximate opening 110. Bosses 112, 114 are preferably constructed to snap fittingly cooperate with a respective shaft 116, 118 defined by lid 30 so as to provide a rotational or pivotable association therebetween to allow the selective opening and closing of lid 30 relative to top 28. A sleeve or guide tube 120 is constructed to be secured to an inwardly facing flange 122 defined by top 28. Guide tube 120 defines a passage 124 that is shaped to receive a stack of disposable lids 60 that slideably cooperate with the interior of guide tube 120.

Although guide tube 120, and more specifically the internal diameter and length thereof may be provided in various sizes so as to provide dispensers useable with variable container lid sizes and various numbers of discrete lids being available for dispensing, each disposable lid 60 associated with a respective dispenser assembly 20 has the same construction as the remaining lids of a stack and commonly cooperates with adjacent lids in an at least slightly nestable or partially nested manner That is, when stacked together, the plurality of lids commonly overlap a portion of the adjacent lids such that the stack of lids provides a limited resistance to translation of the lids out of the stacked configuration. In more common constructions, such disposable container lids are constructed such that the sealing lip of each respective lid flares in an outward radial direction so as to overlap an upward facing contour of a respective lid that is disposed thereunder and/or a drink spout defined by the respective lid is flared or tapers in an in a generally inward radial direction so that a drink spout of a lower lid nests into a drink spout of one or more drink spouts of disposable lids disposed thereof. The respective overlapping portions of the discrete cup lids provides a limited degree of structural retention to stacks of similarly shaped disposable container lids. As disclosed further below, dispensing the discrete lids in a desired "one-at-a-time" and sanitary manner, without damaging the dispensed lid or subsequent lids, requires overcoming those forces attenuate to the stacked and partially nested orientation of the plurality of lids associated with guide tube 120.

Figure 4:
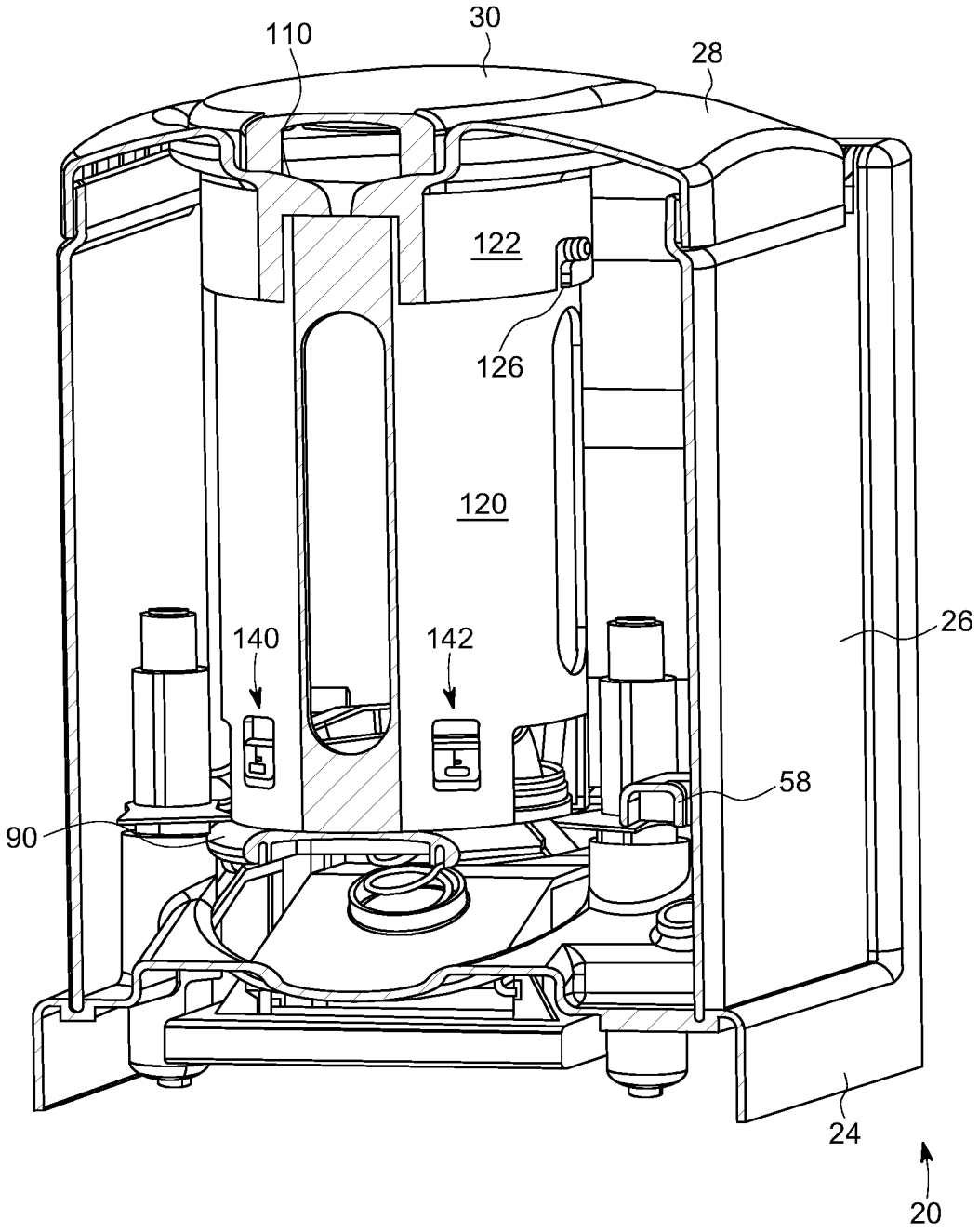
FIG. 4 is a top front right perspective cross section view of the lid dispenser assembly taken along line 4-4 shown in FIG. 1.

Still referring to FIGS. 3-5B, and specifically FIG. 4, one or more channels 126 are formed in flange 122 of top 28 and are shaped to cooperate with respective projections 128, 130 associated with an upwardly directed end 132 of guide tube 120 when dispenser assembly 20 is assembled. During assembly, guide tube 120 is translated in an upward axial direction, indicated by arrow 133 (FIGS. 5A and 5B) and subsequently rotated, indicated by arrow 134, relative to top 28 so as to capture projections 128, 130 associated with guide tube 120 in the respective channels 126 defined by flange 122 of top 28 such that guide tube 120 depends therefrom. That is, when assembled, guide tube 120 is supported by top 28 and oriented to extend in a generally downward direction relative thereto.

Guide tube 120 includes one or more openings 136, 138 that extend in a longitudinal direction along a longitudinal axis thereof. Although only one opening 136,138 may be provided, openings 136, 138 are dispersed about the circumference of guide tube 120 such that when guide tube 120 is attached to top 28, in any rotational orientation wherein projections 128, 130 cooperate with respective channels 126, one of openings 136, 138 is oriented to be generally aligned with lens 62 defined by cover 26 to allow visual inspection of the quantity of disposable lids 60 contained in guide tube 120 without requiring physical interaction with dispenser assembly 20.

One or more cutouts or openings 140, 142 are formed through guide tube 120 and preferably dispersed circumferentially about a perimeter of guide tube 120. During relative motion thereof, respective retention fingers or adjustment fingers 144, 146 slidably cooperate with respective openings 140, 142 and are constructed to securely cooperate with guide tube 120 in one or more of a plurality of positions relative thereto in either or both of a vertical direction, as indicated by arrow 148, and/or in respective inward radial directions, indicated by arrows 150, relative thereto so as to provide an adjustable diameter cross-sectional diameter associated with the footprint of a lower facing end 152 of guide tube 120. Respective fingers 144, 146 are constructed of provide adjustment of the desired cross-sectional shape associated with the lower facing end of guide tube 120 to accommodate the desired operation of dispenser assembly 20 with disposable lids 60 having alternate constructions and/or to accommodate deviations and/or manufacturing tolerances associated with the production of lids 60. When configured in a "ready to dispense" orientation (see FIG. 5A), trap door 90 is maintained in close or physical contact with a lower end 152 of guide tube 120 until the dispense activity is initiated. Such a consideration mitigates instances of tipping or canting of disposable lids 60 from a generally transverse orientation relative to axis 133 of guide tube 120 during use and/or loading of dispenser assembly 20. The suspension of guide tube 120 from top 28 also mitigates undesired translation of guide tube 120 relative to trap door 90 during operation of dispenser assembly so as to maintain a desired repeatable association of trap door 90 with the bottommost lid 60 of the available stack of lids 60 disposed in guide tube 120 after each discrete dispense event.

Figure 5A:
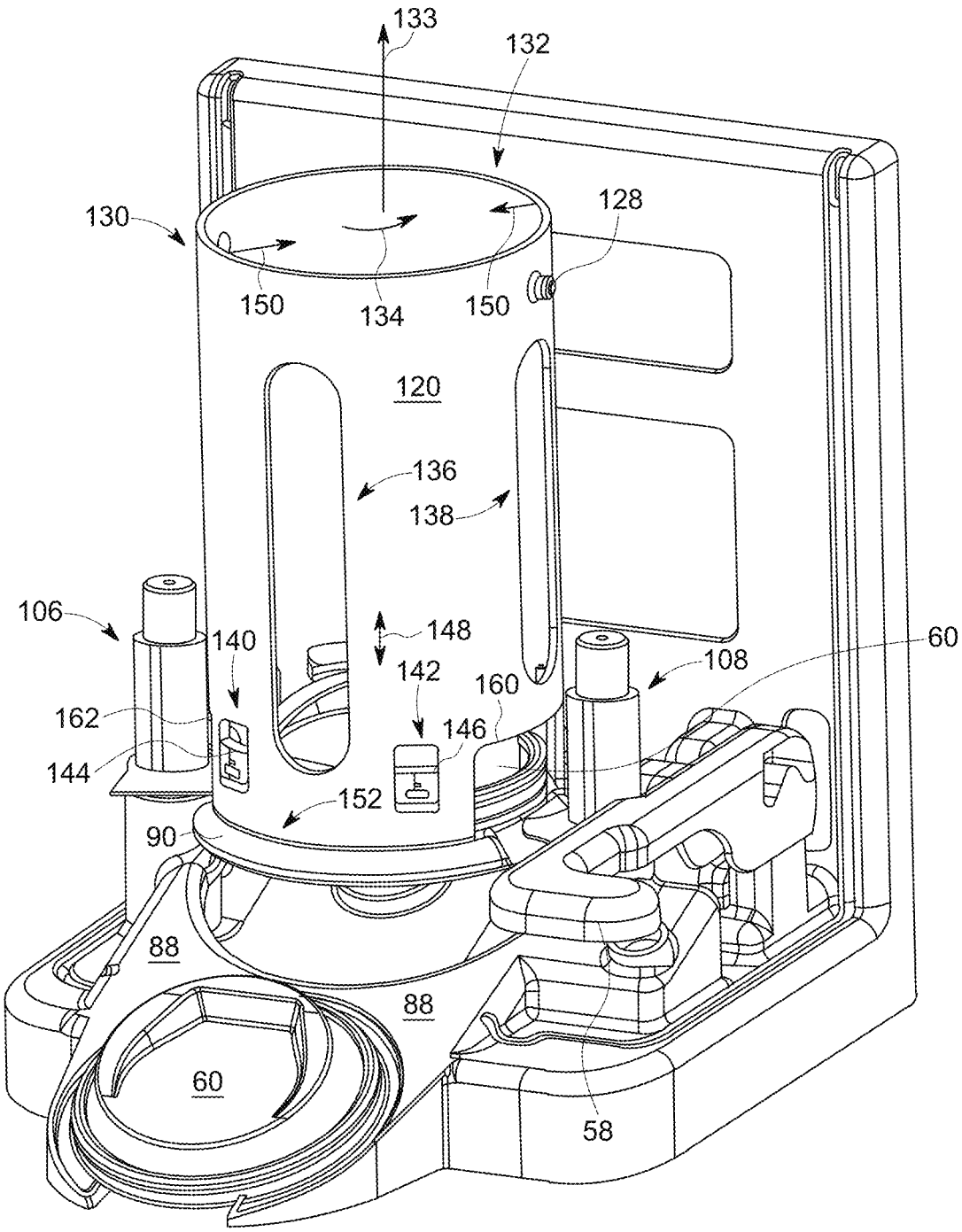
FIG. 5A is a view similar to FIG. 1 with a cover, top, and lid removed from the lid dispenser assembly shown therein and exposing a guide tube of the assembly that is disposed therebehind with the lid dispenser assembly shown in a ready to dispense orientation.
Figure 5B:
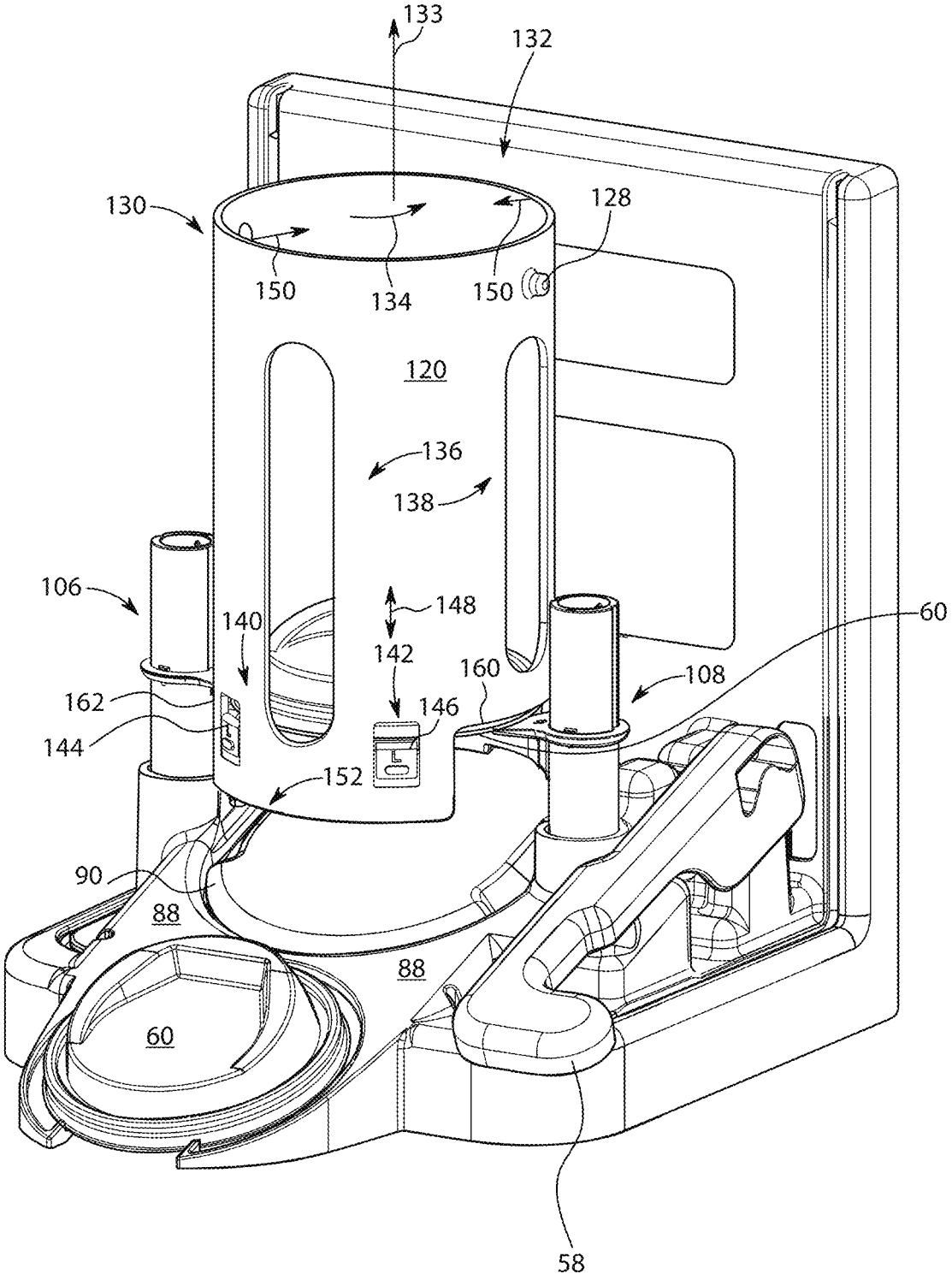
FIG. 5B is a view similar to FIG. 5A with the lid dispenser assembly shown in a dispense orientation.

Still referring to FIGS. 5A and 5B, guide tube 120 includes respective cutouts 160, 162 that are generally aligned with respective upwardly directed portions of separator assemblies 106, 108 which, as disclosed further below, selectively interfere with the respective disposable lids 60 proximate trap door 90 so as to effectuate the sequential separation of a lowermost disposable lid 60 from a respective next to be dispensed lid 60 of the upwardly extending stack thereof. Such a consideration further prevents physical interaction between the discrete separator assemblies 106, 108 and guide tube 120 in a manner that would frustrate the intended operation of the separator assemblies 106, 108 in response to operation of the drive mechanisms associated therewith as disclosed further below.

Figure 6:
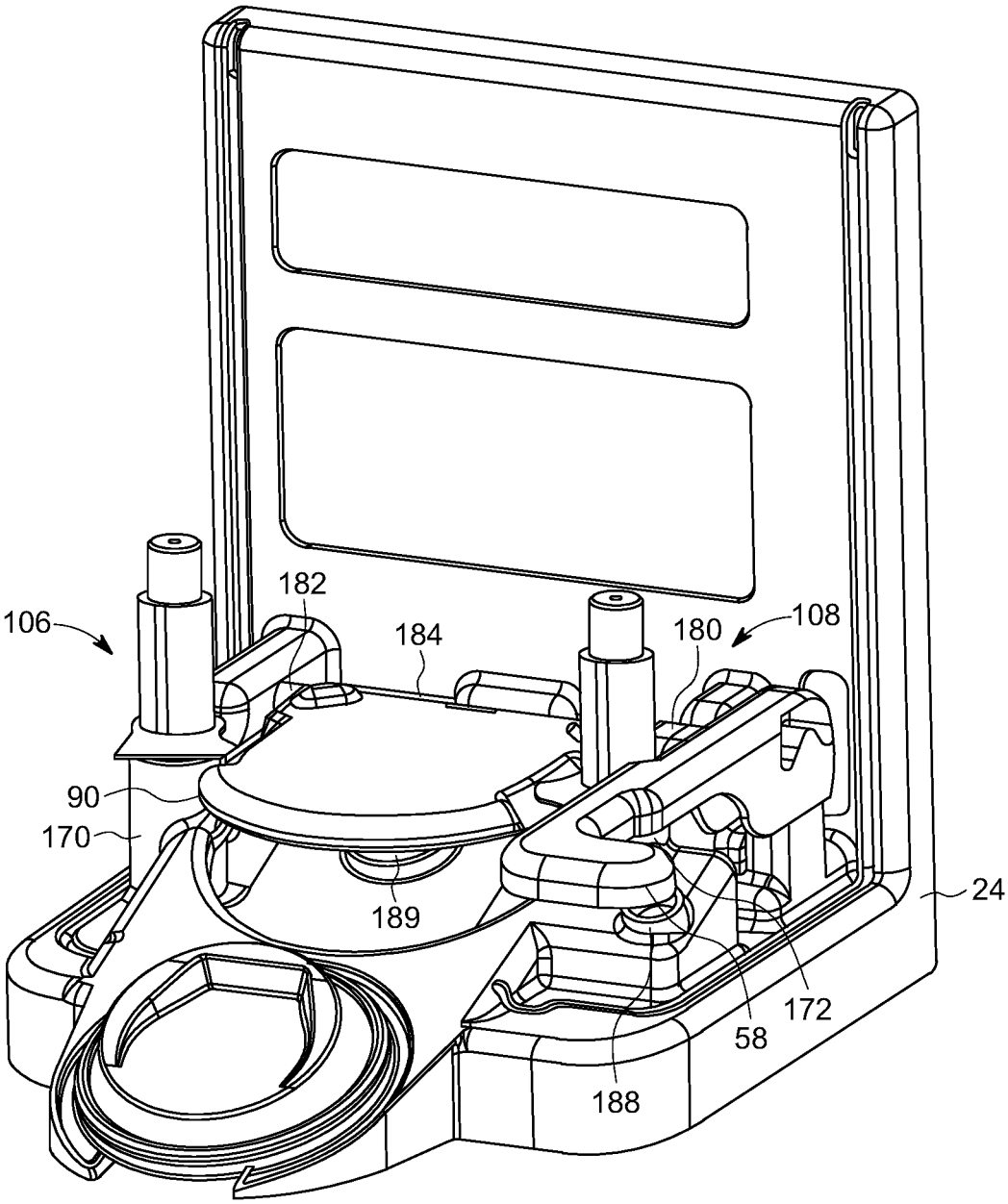
FIG. 6 a view similar to FIG. 5A with the guide tube and a stack of available container lids removed from the assembly shown therein.
Figure 7:
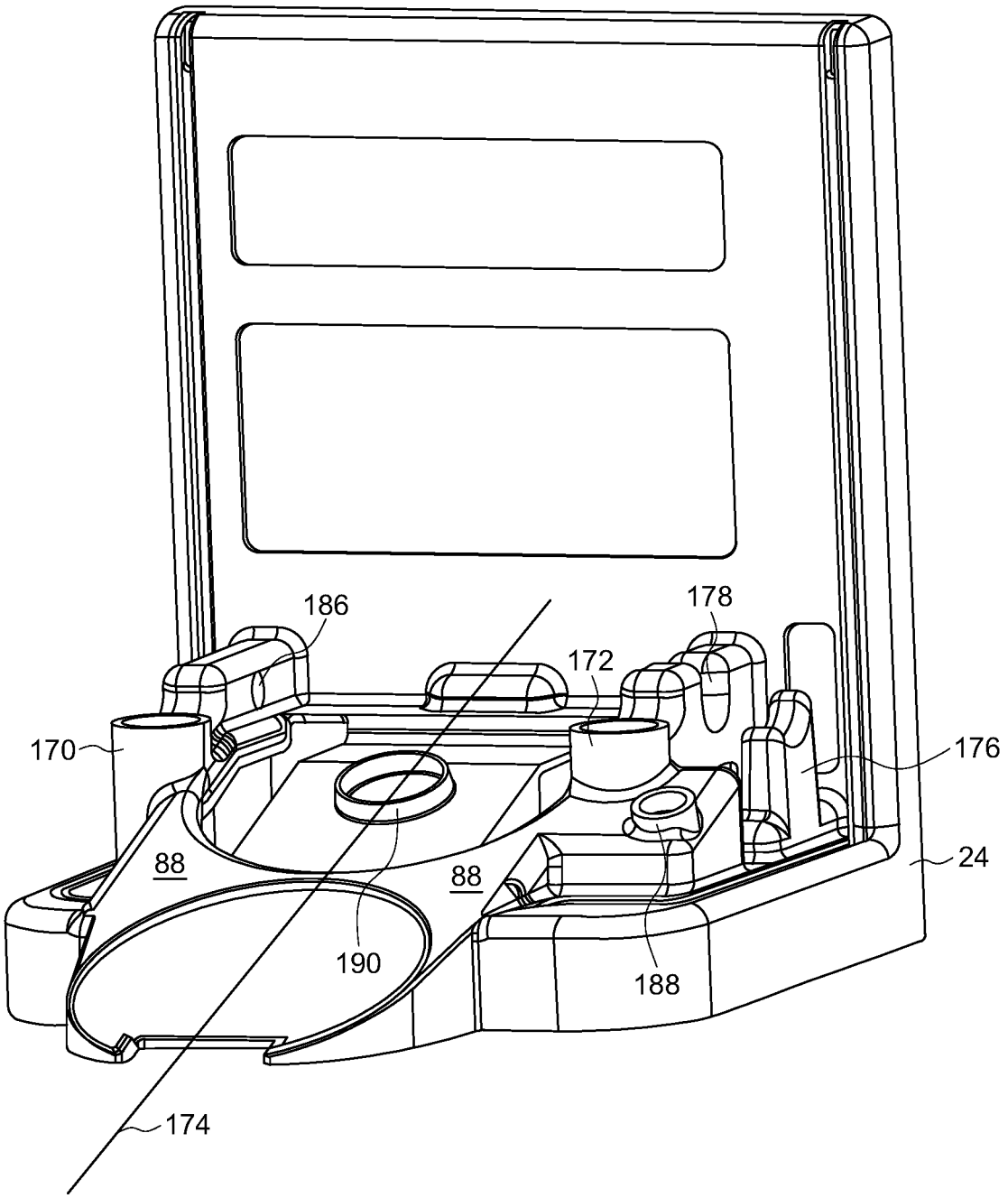
FIG. 7 is a view similar to FIG. 6 with a trap door and a handle removed from the lid dispenser assembly shown therein.

Referring to FIGS. 6 and 7, respective left side separator assembly 106 and right side separator assembly 108 cooperate with respective bosses 170, 172 formed through base 24. Bosses 170, 172 are oriented to respective lateral sides of a medial centerline 174 of base 24 such that respective separator assemblies 106, 108 are oriented to the respective opposite lateral sides of trap door 90. Base 24 includes a post 176 and a projection or saddle 178 that are shaped to cooperate with handle 58. Trap door 90 includes a first projection 180 and the second projection 182 that extend in opposite lateral directions from a rearward facing edge or side 184 thereof. Projection 180 of trap door 90 is constructed to cooperate with saddle 178 and projection 182 of trap door 90 is shaped to cooperate with a cavity 186 defined by base 24 and generally opposite saddle 178 such that an axis 179 associated with projections 180, 182 define an axis of rotation of trap door 90 relative to base 24.

As disclosed further below, base 24 defines one or more cavities or spring seats 188, 189 that are shaped to cooperate with respective biasing devices, such as a spring or the like, to bias handle 58 and trap door 90 toward the "ready to dispense" orientation or configuration, as shown in FIG. 1, relative to base 24 and housing assembly 22. Operation of handle 58 and/or rotation of trap door 90 about axis 179 in a downward rearward direction relative to base 24 effectuates translation of trap door 90 toward the dispense orientation whereas upward and forward rotation of trap door 90 about axis 179 effectuates the return of trap door 90 toward the "ready to dispense" orientation wherein the upper surface of trap door 90 is generally disposed directly beneath and extends generally laterally across the lower end of guide tube 120 after each discrete lid dispense event.

Figure 8:
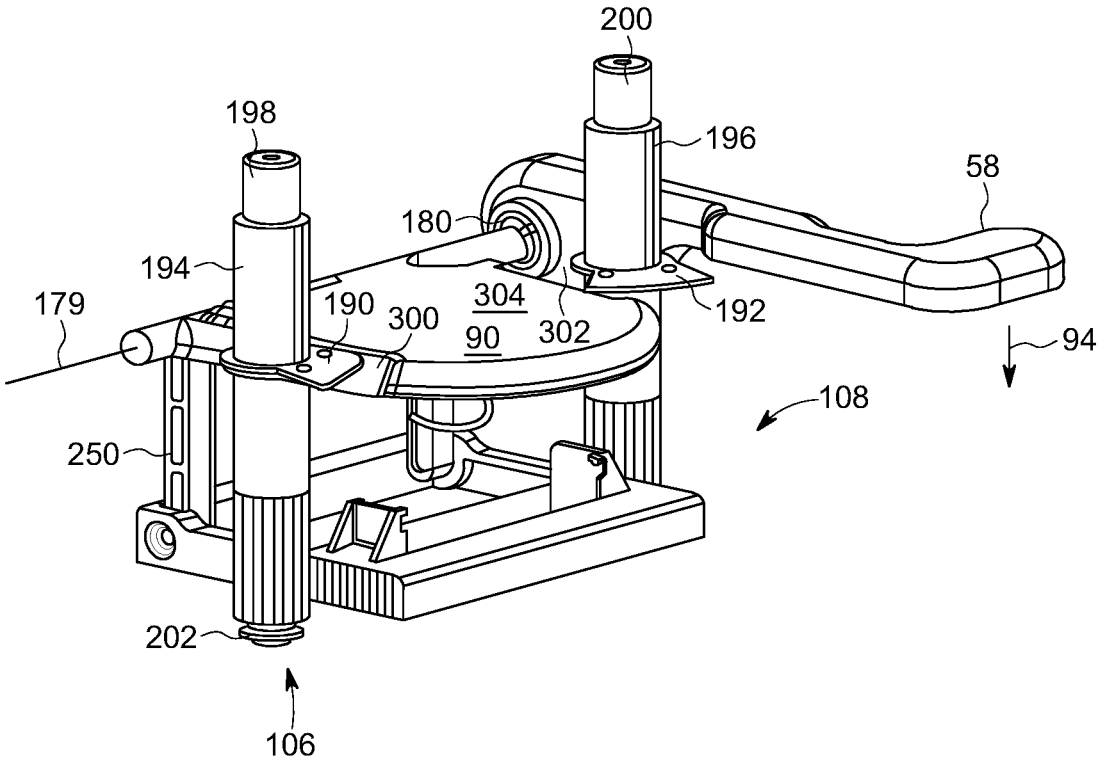
FIG. 8 is a top front left perspective view of the handle, trap door, drive assembly, and separator assembly of the lid dispenser assembly shown in FIG. 1.
Figure 9:
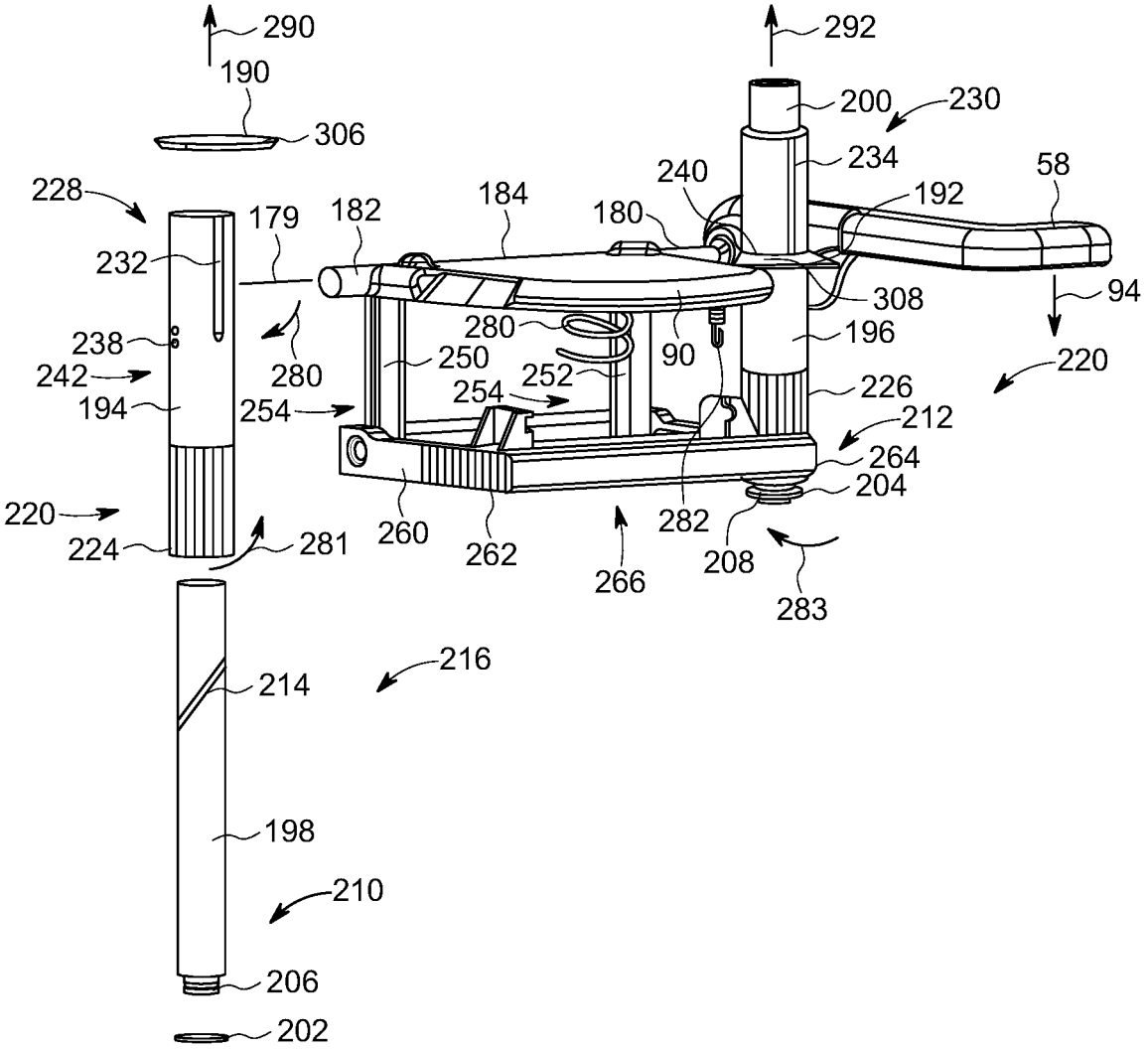
FIG. 9 is a view similar to FIG. 8 and shows a left separator assembly exploded therefrom.
Figure 10:
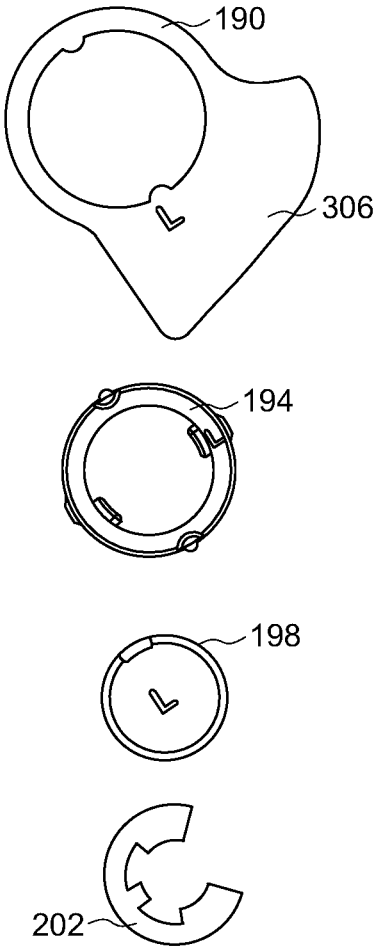
FIG. 10 is a top plan view of the components of the left separator assembly shown in FIG. 9.

Referring to FIGS. 8-10, each respective separator assembly 106, 108 includes a respective first arm and second arm, a respective first separator and second separator, a respective first separation finger and second separation finger, or respective first and second cams 190, 192 that is connected to a respective cam lifter 194, 196. A respective cam drive 198, 200 extends through the corresponding cam lifter 194, 196 and is constructed to be axially secured to base 24 via a retention clip 202, 204 engaged with a groove 206, 208 associated with a lower facing end 210, 212 associated therewith. Each cam drive 198, 200 includes a helical cam path defined by a slot or groove 214 that is formed along an upwardly extending portion 216 thereof. The downwardly directed end 220, 222 of each cam lifter 194, 196 includes a geared or toothed interface 224, 226 formed on a longitudinal and a radially outward facing portion thereof. An upwardly directed portion 228, 230 of each cam lifter 194, 196 includes an elongated slot 232, 234 formed along a portion thereof. A securing device, such as a roll pin 238, 240 or the like cooperates with each respective separation finger 190, 192 and a corresponding bore 242 defined by the respective cam lifter 194, 196 such that the respective separation fingers or cams 190, 192 are secured relative thereto. The respective follower or roll pin 238 passes beyond the radially interior facing surface of the respective cam lifter 194, 196 and slidably cooperates with the respective helical groove 214 formed in a radially outward directed surface of the respective cam drive 198, 200.

Trap door 90 includes respective arms 250, 252 that extend in a downward direction proximate rear facing edge or side 184 thereof and which are laterally inboard of respective projections 180, 182 formed therealong. A lower end 254 of arms 250, 252 are pivotably secured to a floor panel or drive tray 260 that extends generally beneath trap door 90 and such that a portion of base 24 is disposed therebetween. A number of teeth of a rack gear 262, 264 are formed proximate a forward facing edge 266 of drive tray 260 and are oriented to face in generally opposite outward lateral directions of drive tray 260 so as to operatively engage the respective pinion gear or toothed interface 224, 226 associated with the respective cam lifter 194, 196.

When engaged with base 24, downward rotation 94 of handle 58 causes rotation 92 of trap door 90 about axis 179 and rearwardly directed translation of drive tray 260 and the respective rack gears 262, 264 associated therewith relative to base 24. The generally rearward translation of rack gears 262, 264 relative to base 24 causes respective inward rotational translation, indicated by arrows 281, 283 of cam lifters 194, 196 relative to respective cam drives 198, 200. Rotational translation of cam lifters 194, 196 relative to respective cam drives 198, 200 causes respective axially upward and rotational translation of separation fingers 190, 192 and cam lifters 194, 196 as the respective roll pin 238, 240 slidably cooperates with the respective groove 214 defined by the corresponding cam drive 198, 200 so as to effectuate a desired separation between a respective disposable lid in contact with the upwardly directed surface of trap door 90 and an adjacent disposable lid 60 engaged there above via concurrent physical interaction of respective separation fingers 190, 192 with the outward radial edge of the stack of lids 60 at an axial location proximate an area of overlap between the bottommost or respective lower lid 60 associated with the stack and the immediately adjacent overlying lid 60.

One or more biasing devices 280, 282 interact with trap door 90 and/or handle 58 so as to effectuate the return of trap door 90 toward the "ready to dispense" position when the downward pressure associated with user interaction with handle 58 is removed and the dispensed lid has gravitationally translated in the forward and downward direction associated with the upper surface of ramp section 88. Once the downward pressure is removed and the dispensed lid has translated out of positional interference with trap door 90, trap door 90 and handle 58 move toward the ready to dispense orientation while concurrently translating respective rack gears 262, 264 in a forward direction thereby effectuating counter rotation of the respective cam lifters 194, 196 relative to the underlying cam drives 198, 200 and the corresponding regression of the respective pins 238 with the slidable cooperation with the underlying groove 214 toward the bottommost orientation available therebetween. Said in another way, during a discrete dispense event, cam lifter 194 and separation finger 190 rotate in a counterclockwise direction, when viewed from above, and translate in an upward axial direction, indicated by arrow 290 along the axis defined by the respective cam drive 198, 200. Concurrently, cam lifter 196, and the separation finger 192 associated therewith, rotate in a clockwise direction indicated by arrow 283, when viewed from above, and translate in an axial direction, indicated by arrow 292, along cam drive 200. When handle 58 is released, respective separation fingers 190, 192, and the corresponding cam lifters 194, 196, rotate and axially translate along the respective cam drive 198, 200 in generally opposite operational directions so as to return the drive assembly to the "ready to dispense" configuration or orientation.

Still referring to FIGS. 8-10, outward lateral edges of trap door 90 include respective chamfers 300, 302 that extend in downward outward lateral directions relative to a top surface 304 of trap door 90. Respective separation fingers 190, 192 include tapered edge portions 306, 308 and are generally oriented to be laterally aligned with respective chamfers 300, 302 so as to be aligned with or preferably slightly above surface 304 of trap door 90 when oriented in the "ready to dispense" orientation. User interaction with handle 98 effects the laterally inward radial rotation of separation fingers 190, 192 such that the tapered edge portions 306, 308 associated therewith interact with a perimeter edge of a respective disposable lid supported by surface 304, or a radial edge of the next adjacent lid 60 nested therewith, such that continued inward rotation of respective separation fingers 190, 192 and the upward axial translation thereof relative to trap door 90 effectuate a non-marring and non-damaging separation between the disposable lid 60 initially in contact with surface 304 and the disposable lid 60 nested thereupon as well as the remainder of the stack of lids 60 associated with guide tube 120. Preferably, separation fingers 190, 192 interact with the stack of available lids so as to break any vacuum pressure and/or material or nested configuration hysteresis or physical bias between the lowermost lid 60 and the overlying lid 60 to effectuate the desired non-marring or damaging separation of a bottom most disposable lid 60 and a next available adjacent lid 60.

Once separated, separation fingers 190, 192 support the remainder of the stack of disposable lids 60 contained within guide tube 120 while a singular lid 60 previously associated with the bottom of the stack is gravitationally dropped therefrom so as to maintain contact with surface 304 of trap door 90 such that continued rotation of trap door 90 in a downward and rearward direction about axis 179 effectuates the desired slidable association of the discrete separated dispense lid 60 relative to ramp section 88 defined by base 24 thereby effectuating dispensing of a single discrete lid 60 with each actuation of handle 58 associated with dispenser assembly 20.

Although disclosed above as being fully manually operable, it is further appreciated that dispenser assembly 20 could be configured in a touchless and/or electro-mechanical configuration wherein a proximity sensor or the like and an electronic drive mechanism, such as a motor, actuator, or the like, can effectuate the desired rotation of trap door 90 relative to base 24 to effectuate the remainder of the rotational and axially translatable motion of separation fingers 190, 192 relative to base 24 to effectuate the sequential single lid dispense operation of dispenser assembly 20. Whether provided in a fully mechanical, manual, and/or touchless electro-mechanical configuration, dispenser assembly 20 is constructed to provide sequential separation of disposable container lids 60 from a stack of disposable container lids to maintain the sanitary condition of undispensed lids, does not damage, mar, or otherwise render unusable the dispensed lid or lids separated therefrom, and which does so in a highly repeatable manner, which can be economically produced, and provides intuitive operation to both users and service personnel.

Although the invention has been herein shown and described in what is perceived to be the most practical and preferred embodiment, it is to be understood that the invention is not intended to be limited to the specific embodiment set forth above. Rather, it is recognized that modifications may be made by one of skill in the art of the invention without departing from the spirit or intent of the invention and, therefore, the invention is to be taken as including all reasonable equivalents to the subject matter set forth herein.

One embodiment of the invention includes a disposable lid dispenser assembly having a base, a top that is connected to the base, and a lid that is pivotably connected to the top. A guide tube depends downwardly from the top and is generally vertically aligned with the lid and defines a lid stack column. A trap door is disposed beneath the guide tube and pivotable relative to the base. A separator assembly is connected to the base and disposed proximate the trap door. The separator assembly includes a respective first lift arm and a respective second lift arm that are each rotational relative to the trap door and movable between a first position wherein the first lift arm and the second lift arm are disposed outside a vertical footprint defined by the lid stack column of the guide tube and a second position wherein a portion of the first lift arm and the second lift are rotated into the footprint of the lid stack column and vertically translated relative to the trap door.

Another embodiment of the invention that includes or is combinable with one or more of the features, aspects, and objects of the above embodiment includes a lid dispenser assembly having a housing that is defined by a base, a cover panel, a top panel, and a lid that is pivotably connected to the top panel. A guide tube that is shaped to receive a stack of disposable lids is supported by the top panel and extends toward the base. A floor panel is movably connected to the base and disposed proximate a lower end of the guide tube. The dispenser assembly includes a separator assembly that is movable concurrently with the floor panel and operable to interact with a stack of lids disposed in the guide tube to effectuate a physical separation therebetween. The separator assembly includes a first separator finger and a second separator finger that are disposed on generally opposite sides of the guide tube. The first separator finger and the second separator finger are movable in opposite rotational directions, relative to one another, and a common axial direction, relative to the guide tube, to selectively interact with the stack of disposable lids contained in the guide tube during movement of the floor panel.

A further embodiment of the invention that is useable or combinable with one or more of the features, aspects, and objects of the above embodiment includes a method of forming a disposable container lid assembly. The method includes providing a housing that is generally defined by a base, a cover panel, and a top panel. A guide tube is provided and shaped to receive a stack of disposable container lids. The guide tube is constructed to cooperate with the top panel such that the guide tube extends from the top panel toward the base. The dispenser assembly includes a trap door that is constructed to pivotably cooperate with the base. A separator assembly is provided that includes a first separator and a second separator that are disposed on generally opposite lateral sides of the guide tube and supported by the base. A drive arrangement is connectable between the trap door and a separator assembly and operable to cause rotation and axial translation of each of the first separator and the second separator relative to the guide tube concurrently during movement of the trap door relative to the base.

These and other aspects, objects, features, embodiments, and advantages of the invention will become apparent to those skilled in the art from the following claims. It should be understood, however, that the detailed description and the specific examples provided therein, while indicating preferred embodiments of the present invention, are given by way of illustration and not of limitation. Many changes and modifications may be made within the scope of the present invention without departing from the spirit thereof, and the invention includes all such modifications. Other features, objects, aspects, and advantages of the invention made apparent from the above description taken together with the drawings. It is further appreciated that the various features, aspects, objects, and advantages disclosed above are not mutually exclusive to the specific aspects of the invention such that the various discrete features, aspects, objects, and advantages are usable and/or combinable with other another.

I claim:

1. A disposable lid dispenser assembly comprising:

a base;

a top connected to the base and a lid pivotably connected to the top;

a guide tube depending from the top and vertically aligned with the lid and defining a lid stack column;

a trap door disposed beneath the guide tube and pivotable relative to the base;

a separator assembly connected to the base and disposed proximate the trap door, the separator assembly comprising:

a first lift arm and a second lift arm that are each rotational relative to the trap door and movable between a first position wherein the first lift arm and the second lift arm are disposed outside the guide tube and a second position wherein a portion of the first lift arm and the second lift are rotated into the guide tube and vertically translated relative to the trap door;

wherein the separator assembly further comprises a cam lifter and a cam drive associated with each of the first lift arm and the second lift arm;

a gear rack is pivotably connected to the trap door and engaged with a cam gear associated with the cam drive of each of the first lift arm and the second lift arm; and a cam and follower engagement formed between the cam lifter and the cam drive associated with each of the first lift arm and the second lift arm.

2. The disposable lid dispenser assembly of claim 1 further comprising a handle that in operation rotates the trap door relative to the base.

3. The disposable lid dispenser assembly of claim 2 wherein operation of the handle effectuates rotation and vertical translation of the first lift arm and the second lift arm.

4. The disposable lid dispenser assembly of claim 1 wherein the lid is oriented to overlie the vertical footprint of the guide tube.

5. The disposable lid dispenser assembly of claim 1 further comprising an inspection window formed through the top and overlying a passage that is formed along at least a portion of a longitudinal length of the guide tube.

6. A lid dispenser assembly comprising:

a housing defined by a base, a cover panel, a top panel, and a lid pivotably connected to the top panel;

a guide tube shaped to receive a stack of disposable lids and being supported by the top panel and extending toward the base;

a floor panel movably connected to the base and disposed proximate a lower end of the guide tube;

a separator assembly that is concurrently moveable with the floor panel, the separator assembly comprising:

a first separator finger and a second separator finger that are disposed on generally opposite lateral sides of the guide tube, the first separator finger and the second separator finger being movable in opposite rotational directions relative to one another and a common axial direction relative to the guide tube to selectively interact with the stack of disposable lids contained in the guide tube during movement of the floor panel;

a rack gear that is translatable relative to the base and operatively engaged between the separator assembly and a drive assembly; and wherein the rack gear includes a first rack gear and a second rack gear and the separator assembly includes a first cam drive and a first cam lifter associated with the first separator finger and engaged with the first rack gear and a second cam drive and a second cam lifter associated with the second separator finger and engaged with a the second rack gear.

7. The lid dispenser assembly of claim 6 further comprising a slot formed in the guide tube and an inspection window formed through the cover panel and positioned to overlie the slot.

8. The lid dispenser assembly of claim 6 further comprising a plurality of retention fingers connected to the guide tube proximate the floor panel and wherein at least one of the plurality of retention fingers is adjustably connected to the guide tube to manipulate a cross sectional area defined between a radial inward facing boundary defined by the plurality of retention fingers.

9. The lid dispenser assembly of claim 6 wherein the first cam drive and the first rack gear and the second cam drive and the second rack gear are disposed on opposite lateral sides of the floor panel relative to a vertical axis of the guide tube.

10. The lid dispenser assembly of claim 6 wherein the drive assembly is further defined as a handle that is connected to the floor panel and which extends through the cover panel.

11. The lid dispenser assembly of claim 6 further comprising a ramp defined by the base and disposed proximate the floor panel.

12. A method of forming a disposable container lid assembly, the method comprising:

providing a base, a cover panel, and a top panel;

providing a guide tube that is shaped to receive a stack of disposable container lids and constructed to cooperate with the top panel such that the guide tube extends from the top panel toward the base;

providing a trap door that is constructed to pivotably cooperate with the base;

providing a separator assembly having a first separator and a second separator that are disposed on generally opposite lateral sides of the guide tube and supported by the base; and providing a drive assembly connected between the trap door and the separator assembly and operable to cause rotation and axial translation of each of the first separator and the second separator relative to the guide tube concurrently during movement of the trap door relative to the base; and forming a first cam drive defined by the first separator and a second cam drive defined by the second separator wherein the first cam drive and the second cam drive are concurrently operable during operation of the drive assembly.

13. The method of claim 12 further comprising providing a handle that is connectable to the trap door so that operation of the handle effectuates pivoting of the trap door.

14. The method of claim 12 further comprising providing a lid that is pivotably connectable to the top panel to be disposed generally over the guide tube.

* * * * *